US010415113B2

(12) United States Patent
Noé

(10) Patent No.: US 10,415,113 B2
(45) Date of Patent: Sep. 17, 2019

(54) METHOD AND APPARATUS FOR CONTINUOUSLY TREATING METAL STRIP

(71) Applicant: Andreas Noé, Kerken (DE)

(72) Inventor: Andreas Noé, Kerken (DE)

(73) Assignee: BWG BERGWERK-UND WALZWERK-MASCHINENBAU GMBH, Duisburg (DE)

( * ) Notice: Subject to any disclaimer, the term of this patent is extended or adjusted under 35 U.S.C. 154(b) by 945 days.

(21) Appl. No.: 14/056,372

(22) Filed: Oct. 17, 2013

(65) Prior Publication Data

US 2014/0110890 A1 Apr. 24, 2014

(30) Foreign Application Priority Data

Oct. 19, 2012 (DE) ..... 10 2012 110 010

(51) Int. Cl.

| | |
|---|---|
| ***C21D 9/54*** | (2006.01) |
| ***C21D 9/63*** | (2006.01) |
| ***C21D 9/56*** | (2006.01) |
| ***C21D 9/46*** | (2006.01) |
| ***C22F 1/04*** | (2006.01) |

(52) U.S. Cl.

CPC ..... *C21D 9/54* (2013.01); *C21D 9/46* (2013.01); *C21D 9/56* (2013.01); *C21D 9/563* (2013.01); *C21D 9/564* (2013.01); *C21D 9/63* (2013.01); *C22F 1/04* (2013.01)

(58) Field of Classification Search

CPC ..... C21D 9/54; C21D 9/564
USPC ..... 266/103, 114
See application file for complete search history.

(56) References Cited

U.S. PATENT DOCUMENTS

| | | | | |
|---|---|---|---|---|
| 4,218,002 | A | 8/1980 | Whalen | |
| 4,480,777 | A | 11/1984 | Suzuki et al. | |
| 5,431,755 | A | 7/1995 | Hajo et al. | |
| 5,472,528 | A | 12/1995 | Boyer | |
| 5,648,539 | A | 7/1997 | Goodbrand | |
| 5,798,007 | A * | 8/1998 | Boyer et al. | 148/627 |
| 5,964,114 | A | 10/1999 | Noe | |
| 6,309,483 | B1 | 10/2001 | Wang et al. | |

(Continued)

FOREIGN PATENT DOCUMENTS

| | | |
|---|---|---|
| DE | 10326071 A1 | 1/2005 |
| DE | 10337502 A | 5/2005 |

(Continued)

OTHER PUBLICATIONS

"Continous heat treatment of floatingly guided copper alloy strips", Prof.Dr.-Ing. C. Kramer, Heat Processing, Jun. 2003.

(Continued)

*Primary Examiner* — Scott R Kastler
(74) *Attorney, Agent, or Firm* — Andrew Wilford

(57) ABSTRACT

An apparatus for continuously treating metal strip of aluminum, an aluminum alloy, a nonferrous metal, or a nonferrous-metal alloy, has at least one heat-treatment device through which the metal strip passes in a strip-travel plane in a travel direction without contact from an upstream inlet end to a downstream outlet end and having a heating zone at the upstream end and a cooling zone formed by a row extending in the direction of at least two cooling subzones. A strip-centering device between the cooling subzones adjusts a position of the metal strip in the strip-travel plane and transverse thereto.

8 Claims, 1 Drawing Sheet

(56) References Cited

U.S. PATENT DOCUMENTS

| | | | | |
|---|---|---|---|---|
| 6,413,470 | B1 | 7/2002 | Kramer | |
| 2004/0154182 | A1 | 8/2004 | Kramer | |
| 2009/0229712 | A1 | 9/2009 | Ylimaeinen | |
| 2009/0315228 | A1 | 12/2009 | Pasquinet et al. | |
| 2010/0175452 | A1 | 7/2010 | Ohlert et al. | |
| 2014/0110890 | A1* | 4/2014 | Noe | 266/44 |

FOREIGN PATENT DOCUMENTS

| | | | |
|---|---|---|---|
| EP | 1008661 | A2 | 6/2000 |
| EP | 1507013 | A1 | 8/2004 |
| EP | 2468905 | A1 | 6/2012 |
| JP | 58048641 | A | 3/1983 |

OTHER PUBLICATIONS

"Heating and cooling technology in the Continous Annealing", M. Imose, Transactions ISIJ, 1985.

* cited by examiner

Fig. 1 - Prior Art
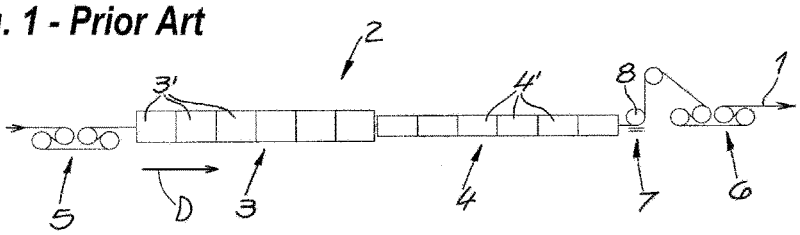
Fig. 2
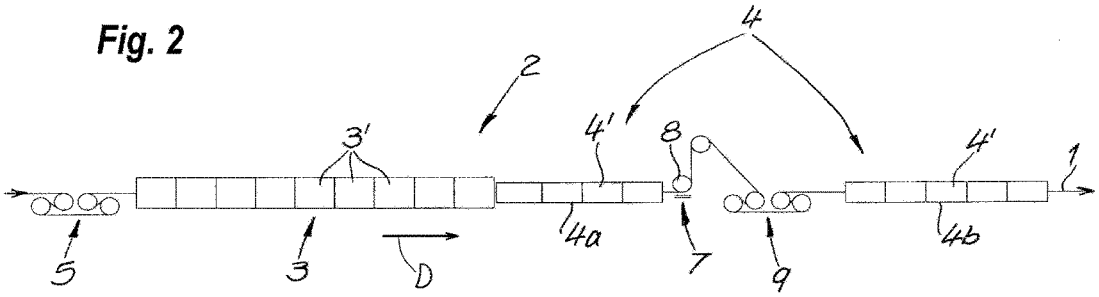
Fig. 3
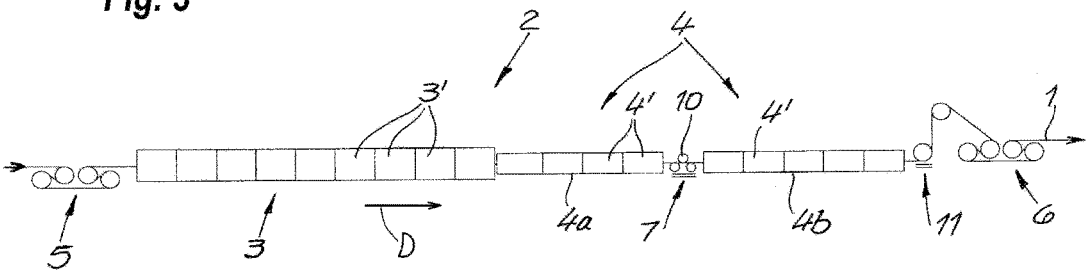

METHOD AND APPARATUS FOR CONTINUOUSLY TREATING METAL STRIP

FIELD OF THE INVENTION

The present invention relates to a method and apparatus for treating metal strip. More particularly this invention concerns the heat treatment of aluminum or nonferrous strip.

BACKGROUND OF THE INVENTION

In device for continuously treating metal strip, in particular a metal strip made of aluminum (or an aluminum alloy) or nonferrous metal (or a nonferrous-metal alloy) typically has at least one heat-treatment device through which the metal strip is passed without contact, and comprising a strip-centering device that adjusts the position of the metal strip within and transverse to the strip-travel plane with or without feedback. The heat-treatment device has at least one heating zone on the upstream inlet end and one cooling zone on the downstream outlet end. The metal strip preferably has a thickness of 0.1 mm to 6 mm.

The heat-treatment device is preferably a noncontact tunnel furnace having a heating zone and a cooling zone. The heating zone usually consists of a plurality of heating subzones (heating and/or holding zones) and the cooling zone usually consists of a plurality of cooling subzones. In such a heat-treatment device, the metal strip is heated to a certain (target) temperature, optionally held at this temperature for a certain period of time and then cooled again. The strip passes through the furnace without contact by suspending the strip between fluid jets from nozzles supplied with appropriately pressurized fluid. The cooling in the cooling zones may be done by air or water or a combination of air and water. Such noncontact tunnel furnaces having a heating zone at one end and a cooling zone at the other end are known (see DE 198 04 184 [U.S. Pat. No. 6,413,470] for example).

Such an apparatus of the above-described type for continuously treating metal strip comprising a heat-treatment device and/or a noncontact tunnel furnace may be, for example, an annealing line and/or a continuous annealing line in which the metal strip is heat treated for metallurgical purposes, for example, to achieve certain strength and deformation properties. Alternatively, however, the apparatus may be a strip-coating system and/or a strip-coating line in which the metal strip is not heat treated for the purpose of annealing but instead to dry a coating on the strip, so that the furnace is then a continuous is dryer.

The metal strip is preferably an aluminum strip or a nonferrous metal strip with a thickness of 0.1 mm to 6 mm.

In annealing lines, for example, the metal strip is heated to temperatures approaching the melting point, so it is usually necessary to set a relatively low tension in the heat-treatment device to prevent the strip from rupturing. The strip tension is dissipated in a tension roller set at the upstream intake end, for example, and then after cooling, it is built up again at the downstream outlet end at another tension roller set. In the heat-treatment device (noncontact tunnel furnace), the specific strip tension amounts to 0.5 to 1 MPa, for example. The strip may "run off center" in particular at low tension in the furnace, for example, due to strip defects, if any, so it is necessary to position the strip in a suitable manner with the help of a strip adjuster, preferably positioning the strip centrally. Consequently, the positioning of the strip is performed transverse to the strip-travel direction and within the strip-travel plane. Such a strip-centering device usually has at least one control roller as well as suitable position sensors (e.g. strip edge detectors). With the systems known in practice, the strip-centering device is downstream of the heat-treatment device, i.e. downstream of the cooling zone. The control roller in practice is usually embodied as a so-called PI strip center regulation, i.e. using a proportional P-component and an integral I-component. The I-component is in the furnace, thereby preventing the strip from running too much off center in the furnace. The control roller usually sits on a movable base frame, which causes the roller to rotate about an imaginary center of rotation and/or about an imaginary axis of rotation situated within the furnace section, where it is perpendicular to the strip-travel plane. Detection of displacement of the roller out of the central axis of the furnace section is the proportional amount while the measure of the skewed position of the roller is the integral amount of the strip center regulation. With the roller positioned at a skewed angle, the strip travels back in the direction of the center of the strip due to the so-called winding effect. Such systems that are known in practice have proven to be fundamentally suitable.

A system of the type defined in the introduction is known from DE 103 37 502, for example. A deflecting roller that serves to control the center of the strip is provided downstream of the furnace having heating zones and cooling zones.

In practice there is a need for more efficient and more productive continuous annealing lines due to the rapidly growing demand for automotive body sheets made of aluminum. To achieve higher production capacities, the strip passes through the treatment section at a higher rate. However, since only a limited heat can be imparted to the strip in each furnace zone, it follows from this that the heat-treatment device would have to be designed with a greater length for a higher production capacity. Since the strip runs off center in the furnace section more easily due to the low strip tension, there is the risk with long furnace lengths that the known strip-centering devices will no longer be sufficient to keep the strip travel stable in the furnace, so there is the risk of the strip running off center laterally and/or running up against the furnace structure. This could then lead to unwanted damage to the strip or to a rupture of the strip, so systems with an increased production capacity cannot be readily implemented in this way. This is where the present invention begins.

OBJECTS OF THE INVENTION

It is therefore an object of the present invention to provide an improved method and apparatus for continuously treating metal strip.

Another object is the provision of such an improved method and apparatus for continuously treating metal strip that overcomes the above-given disadvantages, in particular that has improved strip-position control and guarantees satisfactory running of the strip, especially in lengthy furnace zones.

SUMMARY OF THE INVENTION

An apparatus for continuously treating metal strip of aluminum, an aluminum alloy, a nonferrous metal, or a nonferrous-metal alloy has according to the invention at least one heat-treatment device through which the metal strip passes in a strip-travel plane in a travel direction without contact from an upstream inlet end to a downstream outlet end and having a heating zone at the upstream end and a cooling zone formed by a row extending in the direction of at least two cooling subzones. A strip-centering device between the cooling subzones adjusts a position of the metal strip in the strip-travel plane and transverse thereto.

According to the invention the strip-centering device is consequently no longer downstream of the outlet end of the heat-treatment device and consequently no longer downstream of the last cooling subzone but instead it is integrated into the cooling zone in that the latter is preferably divided into at least two cooling subzones. In a first section the strip is cooled down to the extent that it can easily pass through the strip-centering device. The strip-centering device is therefore downstream of the first cooling subzone. The strip next passes through the second cooling subzone and consequently the second part of the cooling zone so that the strip can then be cooled down to the desired final temperature. It is possible in this way on the whole to work with a long furnace and therefore with long heating and cooling zones, so that the production capacity is increased without having to significantly increase the free strip length in the region of low strip tension. An unacceptable off-center running of the strip in the furnace is therefore reliably prevented in this way.

The strip-centering device itself may be designed in the traditional way and consequently traditional approaches may be used. According to the invention, the special positioning of the strip-centering device within the furnace section and/or within the cooling zone is important.

The strip-centering device may thus have a traditional adjustable deflecting roller, e.g. a 90° deflecting roller for strip position control, for example, and/or may be designed as such. However, it is advisable to provide the deflecting roller with a suitable (high) temperature-resistant coating because the temperature of the strip between the first cooling zone and the second cooling zone is preferably 100° C. to 200° C., especially preferably 120° C. to 150° C. As an alternative to a 90° control roller, it is possible to work with a different type of strip center control, for example, with the help of a multiroller control apparatus, for example a three-roller adjusting apparatus or a control driver (e.g. a pair of rollers). Again in this case, suitable coatings are preferably provided. The strip-position control and/or the strip center control is/are designed as PI regulation in a manner that is basically known. Consequently, the control roller and/or the multiroller arrangement sits on a movable base frame in a manner that is fundamentally known. This frame causes the roller(s) to rotate about an imaginary center of rotation that in turn is in the furnace. The extend of displacement of the roller out of the central axis of the furnace section is the proportional amount, while the extent of skewed position of the roller is the integral component of the strip center control.

As an alternative, the strip-centering device may be a strip-centering device that operates without contact. To do so, the strip center control may be accomplished in a noncontact manner, for example, by linear motors. It is fundamentally possible here to use known arrangements for influencing the metal strip with the help of linear motors as described in DE 197 19 994 [U.S. Pat. No. 5,964,114], for example.

The strip-treating apparatus preferably has a first set of tension rollers at the upstream inlet end upstream from the heat-treatment device to reduce the strip tension. Furthermore, there is an additional set of tension rollers at the downstream outlet end downstream of the heat-treatment device, such that the strip tension is increased again with this set of tension rollers so that additional process steps may then follow, e.g. straightening, cleaning or edge trimming.

It is optionally within the scope of the invention that an (additional) set of tension rollers is provided between the first cooling subzone and the second cooling subzone downstream of the strip-centering device to increase the strip tension on both sides of this location. This has the advantage that the strip may pass through the second part of the cooling zones with a somewhat elevated strip tension. Again in this case, it is advantageous to provide the rollers of such a roller set with appropriate temperature-resistant coatings. According to the invention, it is important that strip-position control is effected between the first cooling subzone and the second cooling subzone. It may optionally be advantageous to provide an additional strip-centering device downstream of the second cooling subzone. This may be advantageous in particular if an additional set of tension rollers is not provided between the first cooling subzone and the second cooling subzone so that the system works with a lower strip tension in the second cooling subzone. If a set of tension rollers is provided between the two cooling subzones and as a result the strip tension is already increased at this point, it may be possible to omit a second strip-centering device downstream of the second cooling subzone.

Dividing the cooling zone into two cooling subzones has the result that the two cooling subzones are (substantially) shorter than a corresponding uniform cooling subzone. The entire heat-treatment device can be lengthened in comparison with traditional systems in this way, i.e. the heating zone may be lengthened and the total cooling zone may also be lengthened.

The subject matter of the present invention is also a method for continuously treating a metal strip using an apparatus of the type defined in the introduction such that the metal strip is guided through the heating zone and the cooling zone without contact during this thermal treatment. This method is characterized in that the position of the metal strip (within the strip-travel plane and transverse to the strip-travel direction) is controlled or regulated with a strip-centering device arranged within the cooling zone.

As already described, such a strip-centering device is preferably equipped with suitable sensors and a feedback loop so that there is accurate control of the strip position. However, embodiments that work without measurement and/or without feedback and in which the strip position is just controlled but there is no feedback control are fundamentally also covered by the invention.

The first cooling subzone is preferably of such a length that the temperature of the metal strip is up to 200° C., for example 100° C. to 200° C., between the first cooling subzone and the second cooling subzone and consequently at the strip-centering device. The temperature is especially preferably up to 150° C., for example 120° C. to 150° C. The length of a second cooling subzone may thus be such that the strip is discharged at a temperature of up to 70° C., for example preferably up to 60° C., for example 40° C. to 60° C., so that additional process steps, for example straightening, cleaning or edge trimming may be carried out with no problems.

The system according to the invention may be an annealing line, for example, or as a component of an annealing line. The heat-treatment device is then an annealing furnace. Alternatively the system may be a strip-coating system or part of a strip-coating system. The heat-treatment device is a dryer and/or a dryer furnace. In both cases the furnaces/dryers are preferably noncontact tunnel furnaces.

BRIEF DESCRIPTION OF THE DRAWING

The above and other objects, features, and advantages will become more readily apparent from the following description, reference being made to the accompanying drawing in which:

FIG. 1 is a simplified schematic view of a prior-art strip-treating apparatus according to the prior art, FIG. 2 is a simplified schematic diagram of a strip-treating apparatus according to the invention, and FIG. 3 shows a modified embodiment of the system of FIG. 2.

SPECIFIC DESCRIPTION OF THE INVENTION

As seen in FIG. 1, a prior-art strip-treating apparatus for continuously treating metal strip, namely thermal treatment has a heat-treatment device 2 designed as a noncontact tunnel furnace. The metal strip 1 passes in a travel direction D lying in a horizontal strip plane through this noncontact tunnel furnace 2 in a noncontact process, in that the strip is suspended between pressurized air issuing from upper jets and lower jets. No details are shown here. The noncontact tunnel furnace 2 has a heating zone 3 at the upstream inlet region and a cooling zone 4 at the downstream outlet region. The heating zone is usually comprised of multiple heating subzones 3', and the cooling zone is usually comprised of multiple cooling subzones 4' such that the individual subzones are controllable individually, i.e. separately. The metal strip is usually heated with the help of air in the heating zones, so that the jets, for example the lower jets, can also assume the temperature-control function in addition to a support function. The cooling in the cooling zones is usually also performed by air or by a combination of air and water.

In the case of an annealing line for aluminum strips for automotive use, the target temperature in the heating zone is approximately 550° C. to approximately 570° C., for example. The heating zones therefore comprise heating and holding zones. It can be seen that the system has a set of tension rollers 5 at the upstream inlet end with which the strip tension is reduced to a specific strip tension of 0.5 to 1 MPa, for example.

Downstream of the noncontact tunnel furnace 2 and/or downstream of the last cooling subzone, the metal strip 1 is maintained at a centered position with the help of a strip-centering device 7, i.e. the position of the metal strip is adjusted within the strip-travel plane and transverse to the strip-travel direction. Then the strip tension is again increased to the usual line level of specifically 10 to 20 MPa, for example by a set of tension rollers 6 at the downstream outlet end. Because of the low specific strip tension within the noncontact tunnel furnace, it is necessary to center the metal strip 1 with the help of the strip-centering device 7.

To increase the production capacity of such a system as that shown in FIG. 1, it is necessary to lengthen the noncontact tunnel furnace. With the state-of-the-art system shown in FIG. 1, there is the risk that, beyond a certain length of the noncontact tunnel furnace, the strip-centering device 7, for example the control roller 8, will no longer be sufficient so is movement of the strip through the furnace can become unstable, with the strip skewing laterally and/or coming into contact with the furnace structure. This could lead to unwanted damage to the strip or even rupture of the strip, so that merely lengthening the noncontact tunnel furnace is not advisable without taking additional measures.

Therefore, according to the present invention the strip-centering device 7 is no longer downstream in the direction D of the heat-treatment device 2 and consequently is no longer downstream of the cooling zone 4 but instead is within the cooling zone 4 per se. This is shown in FIGS. 2 and 3 that show respective embodiments of the invention. FIGS. 2 and 3 in turn show a strip-treating apparatus having a heat-treatment device 2 that in turn has a heating zone 3 in the upstream inlet region and a cooling zone 4 in the downstream outlet region. One set of tension rollers 5 is again provided at the upstream inlet end, and another set of tension rollers 6 may again be provided at the downstream outlet end, as shown FIG. 3 but not in FIG. 2.

The heating zone 3 is in turn made up of multiple heating subzones 3', while the cooling zone 4 is made up of multiple cooling subzones 4'. According to the invention, the cooling zone 4 is divided into two cooling subzones, namely a first cooling subzone 4*a* and a subsequent second cooling subzone 4*b*. The strip-centering device 7 is according to the invention between the first cooling subzone 4*a* and the second cooling subzone 4*b*.

The metal strip is heated to the desired temperature in the heating zone 3 with the heating and holding subzones 3' by a known method, and this temperature can then be maintained over a desired period of time. The heating zone 3 need not be modified is subsequently in comparison with the prior art—except for lengthening it. Then the first cooling subzone 3*a* immediately downstream of the heating zone 3 cools the metal strip in a first step, preferably to a temperature of 100° C. to 200° C., for example 120° C. to 150° C. After emerging from the first cooling subzone 4*a*, the strip is centered with the help of the strip centering centering device 7.

In the embodiment according to FIG. 2, it has a 90° control roller 8. In the embodiment according to FIG. 2, this is followed by another set of tension rollers 9 to increase the strip tension. Then the strip passes through the second cooling subzone 4*b*, so that it is cooled down to the desired final temperature of 40° C. to 60° C., for example. It is possible to increase production capacity in this way without significantly lengthening the free strip length, thereby avoiding an inadmissible strip wandering in the furnace. Another strip-centering device and/or another set of tension rollers may then follow the second cooling subzone 4*b*. This is not illustrated in FIG. 2.

FIG. 3 shows a modified embodiment of the invention in which the strip centering centering device 7 is a three-roller strip center control with three rollers 10. Furthermore, FIG. 3 shows that another strip center adjusting apparatus 11 and another set of tension rollers 6 may be downstream of the second cooling subzone 4*b*. The additional strip center control 11 downstream of the second cooling subzone 4*b* is appropriate because with this embodiment no set of tension rollers is arranged between the cooling zones 4*a* and 4*b* and therefore the second section 4*b* also operates at a lower strip tension.

To compare FIGS. 1 and 2, for example, it can be seen that the furnace subzones 3', 4' in the embodiment according to the invention have a length greater than the length in the known embodiment according to FIG. 1 on the whole. Nevertheless, the free strip length is not greater because the strip center control 7 follows the first cooling subzone 4*a*. Thus the heating zone 3 and the cooling zone 4 can both be lengthened significantly in comparison with the prior art.

However, this division of the cooling zone 4 results in cooling subzones 4*a*, 4*b* that are (substantially) shorter than the heating zone 3.

I claim:

1. An apparatus for continuously treating strip of aluminum, an aluminum alloy, a nonferrous metal, or a nonferrous-metal alloy, the apparatus comprising:

at least one noncontact tunnel furnace having relative to a strip-travel direction an upstream inlet end, a downstream outlet end, a heating zone at the upstream end, a first cooling subzone downstream of the heating zone, and a second cooling subzone spaced downstream in the direction from the first cooling subzone;

means for moving the strip through the tunnel in the strip-travel direction;

guide means for supporting the strip on movement of the strip in the heating zone and cooling subzones zones in a plane including the strip-travel direction with the strip moving without contact through the heating zone and cooling subzones; and a strip-centering linear motor out of contact with the strip and between the first and second cooling subzones for adjusting a position of the metal strip in the strip-travel plane land transverse thereto.

2. The strip-treating apparatus defined in claim 1, wherein the means for moving include:

means upstream of the upstream end for decreasing tension in the strip in the heating and cooling zones; and means downstream of the downstream end for increasing tension in the strip downstream of the downstream end.

3. The strip-treating apparatus defined in claim 1, further comprising:

a second strip-centering linear motor downstream of the second cooling subzone for adjusting a position of the metal strip in the strip-travel plane and transverse thereto.

4. A method of continuously treating strip of aluminum, an aluminum alloy, a nonferrous metal, or a nonferrous-metal alloy, the method comprising the steps of:

transporting the strip in a strip-travel plane and in a strip-travel direction through a noncontact tunnel furnace having an upstream heating zone, a first downstream cooling subzone and a second downstream cooling subzone spaced in the direction from the first cooling subzone such that the strip is heated in the heating zone and cooled in the first and second cooling subzone;

supporting the strip only on a fluid cushion in the noncontact tunnel furnace and keeping the strip out of contact with the furnace; and adjusting a position of the strip in the noncontact tunnel furnace in the strip-travel plane and transverse thereto with a strip-centering linear motor between the first and second subzones and out of contact with the strip to center the strip in the noncontact tunnel furnace.

5. The strip-treating method defined in claim 4, further comprising the steps of:

reducing tension in the strip generally at the upstream end; and increasing tension in the strip generally at the downstream end.

6. The strip-treating method defined in claim 4, wherein the strip position is controlled with a PI adjusting method comprising a proportional P component and an integral I component.

7. The strip-treating method defined in claim 4 wherein at the strip-centering linear motor the strip has a temperature of 100° C. to 200° C.

8. The strip-treating apparatus defined in claim 1, wherein the guide means includes jets in the furnace forming a fluid cushion underneath and supporting the strip.

* * * * *